United States Patent [19]

Stiles

[11] Patent Number: 5,052,363

[45] Date of Patent: Oct. 1, 1991

[54] EGR CONTROL VALVE HAVING CERAMIC ELEMENTS

[75] Inventor: Ernest D. Stiles, St. Clair Shores, Mich.

[73] Assignee: Ford Motor Company, Dearborn, Mich.

[21] Appl. No.: 600,649

[22] Filed: Oct. 22, 1990

[51] Int. Cl.[5] ..... F02M 25/06

[52] U.S. Cl. ..... 123/568; 251/368; 277/96.2

[58] Field of Search ..... 123/568; 277/96.2, DIG. 6; 251/368, 214

[56] References Cited

U.S. PATENT DOCUMENTS

| | | | |
|---|---|---|---|
| 4,044,737 | 8/1977 | Nishimura | 123/568 |
| 4,693,481 | 9/1987 | Quinn | 277/96.2 |
| 4,871,297 | 10/1989 | Boes | 277/96.2 |

*Primary Examiner*—Robert G. Nilson

*Attorney, Agent, or Firm*—Joseph W. Malleck; Roger L. May

[57] ABSTRACT

An EGR valve assembly for use in an EGR valve body having a chamber with an inlet and outlet, comprising: (a) a stemmed reciprocable valve controlling flow into said chamber, the stem of said valve being constituted of an iron-based core material (i.e., 300 seeries stainless steel) impregnated at its outer surface with an ingredient (i.e., electroless nickel, ion implanted or chemically deposited nitrides, and electrolytic chromium) that is compatible in sliding contact with ceramic and provides said stem with a hardness at room temperature of at least 60 $R_c$ and a lubricating oxidized passivation layer at a temperatures in excess of 600° C., and (b) a ceramic-based bushing (SiC, $Si_3N_4$, $Al_2O_3$, ceramic/metal composite) for sealingly guiding the reciprocal movement of said stem.

9 Claims, 5 Drawing Sheets

EGR CONTROL VALVE HAVING CERAMIC ELEMENTS

BACKGROUND OF THE INVENTION

1. Technical Field

This invention relates to the art of increasing the wear resistance of exhaust gas recirculation (EGR) valve bushings and valve stems used in internal combustion engines, and particularly to techniques for elevating the operating temperature of such EGR components.

2. Discussion of the Prior Art

The earliest EGR systems used in most vehicles (starting in 1972–73) were designed to reduce emissions of oxides of nitrogen ($NO_x$). They have also been influenced drivability, octane rating requirements, and fuel economy of some vehicles. The reduction of $NO_X$ is accomplished by lowering engine combustion temperature by recirculating metered amounts of burned exhaust gases back through the intake manifold where such gases are mixed with a fresh air/fuel mixture.

Current EGR valve designs (see U.S. Pat. No. 4,044,737) operate at temperatures in the range of 650°–750° F., permitting use of relatively economical materials for the valve stem (such as stainless steel) and for the bushing (such as bronze impregnated with graphite). With the projected increase in durability standards for automotive components, such current EGR valve design will be expected to survive 50,000–100,000 miles of engine operation with little change in leakage. Such known materials may exhibit excessive wear at the bushing-stem interface for such extended periods.

More importantly, there is a desire to raise the design requirements for EGR valves to intermediate operating temperatures in the range of 800°–900° F. and in certain truck applications to operating temperatures in the range of 900°–1200° F. Such increases in temperature may be brought about by (i) increasing the exhaust gas recirculation flow which is either needed to achieve emission standards and possibly increase fuel economy and thereby help meet federal corporate average fuel economy (CAFE) requirements, or (ii) locating or burying the EGR valve assembly closer to the exhaust manifold.

At such higher operating temperatures, the existing bushings deteriorate dramatically, possibly due to the oxidation of graphite from the impregnated bronze and at even higher temperatures accompanied by the oxidation of the bronze metal; oxidation results in unacceptable wear and valve leakage. There may also be, at such increased exhaust recirculation flows, a tendency for increased deposits on the valve stem which is exposed to such gases; this results from the chilling effect on the stem which is alternately exposed to a relatively cool environment.

Ceramic materials are well known for their wear resistance, tolerance to elevated temperatures, and their hardness. However, ceramics are brittle in tension making them undesirable as valve stem materials; moreover, ceramics do not wear well in sliding engagement with each other nor promote wear with known high temperature metal alloys needed for valve stem constructions such as stainless steel. Thus, there is a clear need for improved material system design of the valve assembly to meet these changing conditions and to permit use of ceramics.

SUMMARY OF THE INVENTION

This invention has discovered that interfacing a select ceramic (that which has combined high wear resistance, corrosion resistance, and dimensional stability at temperatures far in excess of 800° F.) with a select ingredient physically impregnated onto high temperature resistant steels (the ingredient group consisting of nitrides impregnated by ion implantation or chemical nitriding, electroless nickel, and electrolytic chromium) will achieve such goal.

More specifically, the invention is an EGR valve assembly for use in an EGR valve body which defines a chamber with an inlet and outlet, comprising: (a) a stemmed reciprocable valve controlling flow into said chamber, the stem of said valve being constituted of an iron-based core material impregnated at its outer surface with an ingredient that is compatible in sliding contact with ceramic and provides said stem with a hardness at room temperature of at least 60 $R_c$ and a lubricating oxidized passivation layer at temperatures in excess of 600° C.; and (b) a ceramic-based bushing for sealingly guiding the reciprocal movement of said stem.

Preferably, the iron-based core material consists of Series 300 or 400 stainless steel; the ceramic-based bushing is constituted of a material selected from the group consisting of silicon carbide, silicon nitride, alumina, or mixtures thereof, and a ceramic/metal matrix with the matrix being metal or ceramic. The impregnation ingredient is selected from the group consisting of electroless nickel, electrolytic chromium, and nitrides impregnated by ion implantation or bath nitriding.

The resulting sealing relationship achieved by the bushing and stem is limited to leakage no greater than 0.6 cfm during the entire useful life of the EGR valve assembly and at least a period of reciprocation during 50,000 miles of automotive engine use.

SUMMARY OF THE DRAWINGS

The novel features of the invention are set forth with particularity in the appended claims. The invention itself, however, both as to its organization and method of operation, together with further objects and advantages thereof, may best be understood by reference to the following description taken in conjunction with the accompanying drawings, in which:

DETAILED DESCRIPTION AND BEST MODE

High operating temperatures and severe vibrations are the major Problem areas in future design and manufacture of EGR valves: exhaust gas temperatures in excess of 300° F., and vibrations of 50–1050 Hz accompanied by accelerations to 25.0 G's. This invention overcomes both problems; conventional valves will deteriorate rapidly when subjected to such temperatures and vibration.

Figure 1:
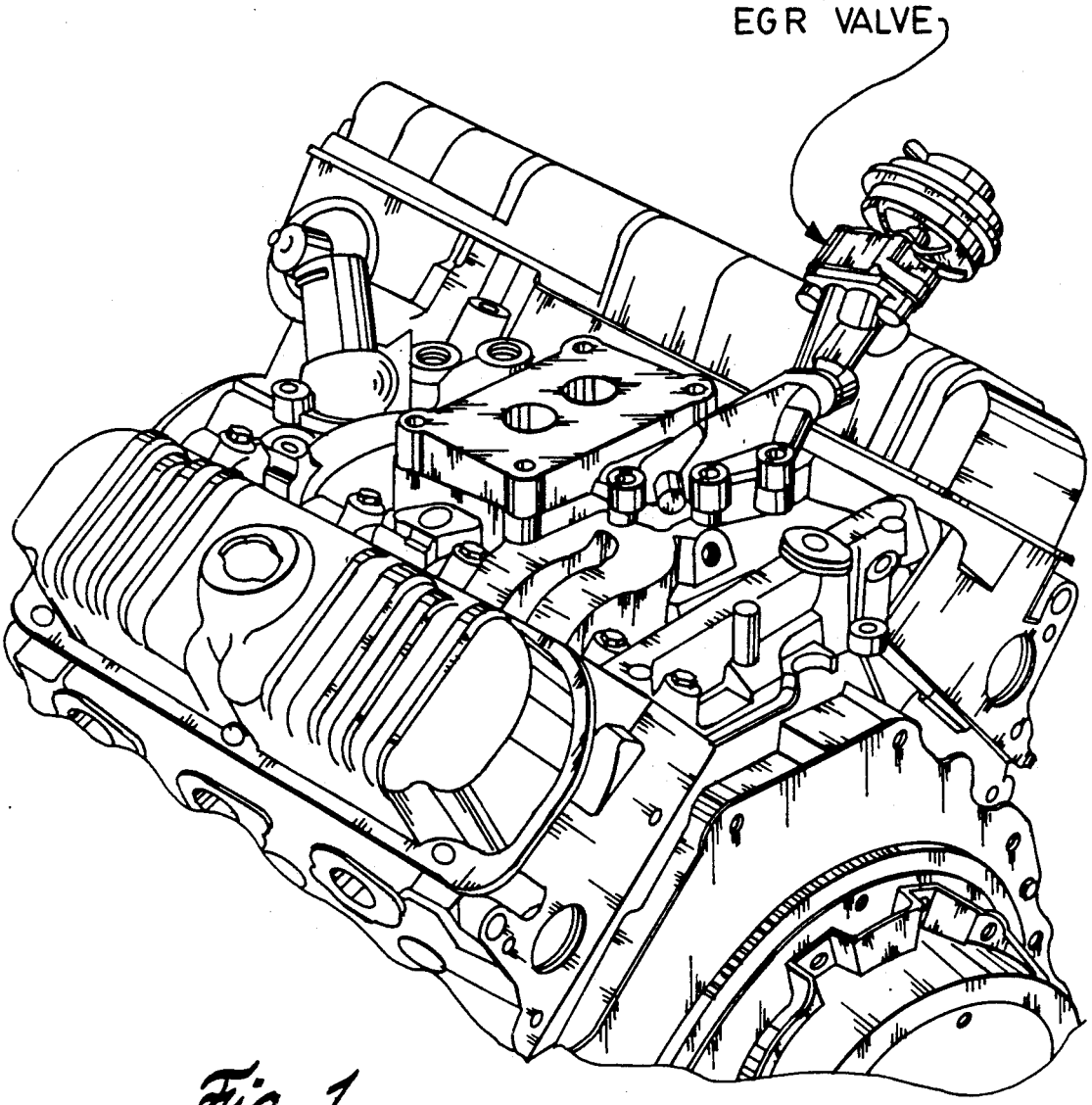
FIG. 1 is a perspective view of an engine depicting an EGR valve in an exposed relatively cool location relative to the engine, characteristic of prior art applications.

EGR valve bodies are made from sintered powder metal iron where external configuration and coring permit the bodies to be made with straight pulls. For more complicated contours in coring, machined gray iron castings are used. EGR valve assemblies are routinely located in a region about the engine that is separated from the hot exhaust manifold. A view of such an assembly appears in FIG. 1. An EGR valve assembly in such location would experience bushing temperatures in the range of 650°-750° F. If the EGR valve assembly were to be located or buried close to the exhaust manifold, as is contemplated for future applications, it will experienc. bushing temperatures of 800°-1200° F. Durability and wear resistance in such severe environment is difficult to achieve.

Figure 2:
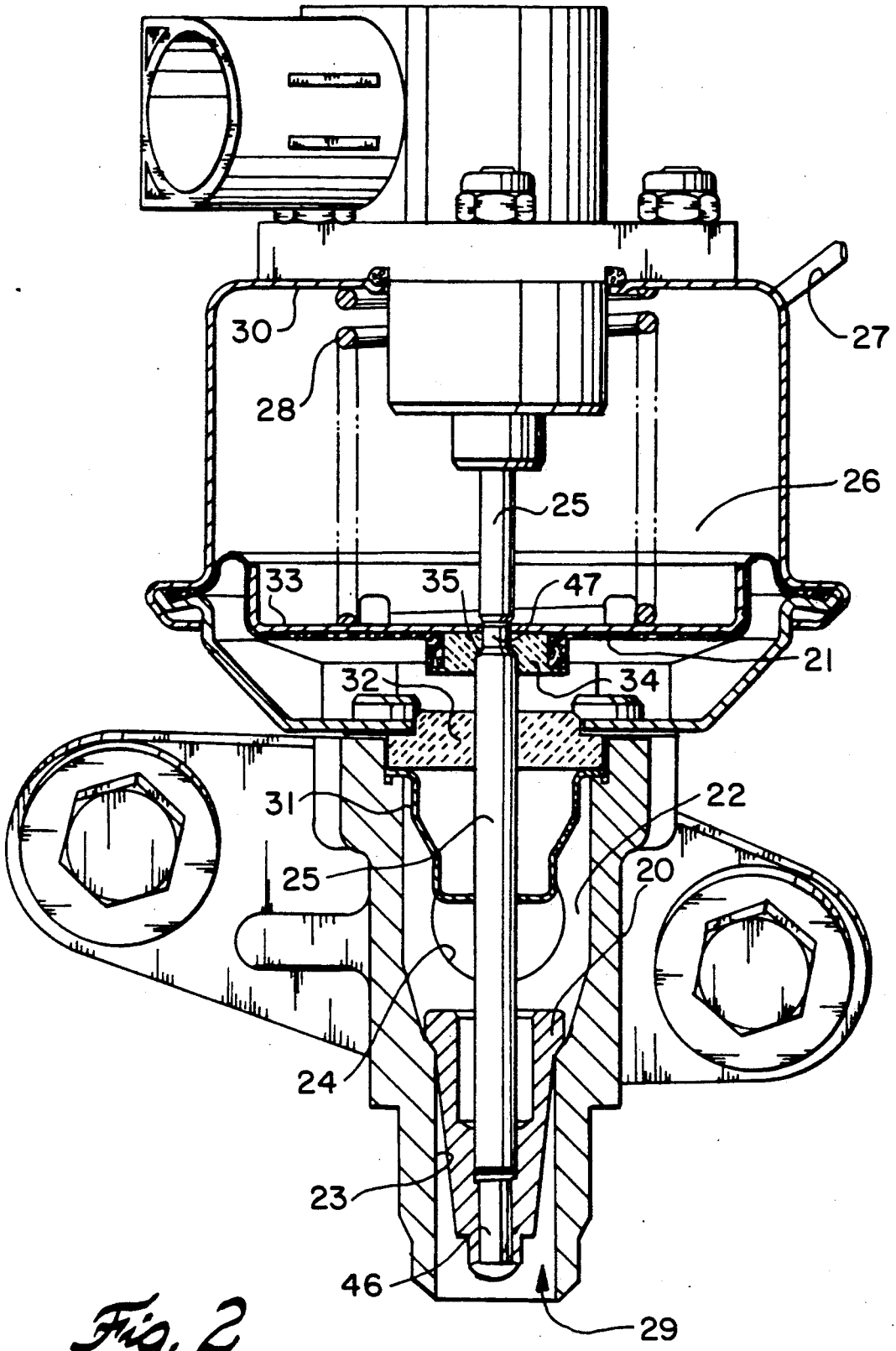
FIG. 2 is a central sectional elevational view of a sonic type of EGR valve embodying the principles of this invention.

As shown in FIG. 2, the valve closure member 20 controls the flow 29 of gas into a gas chamber 22 located between an inlet port 23 and an outlet 24. The closure member 20 is mechanically connected to a diaphragm 21 by a valve stem 25, the diaphragm 21 forming one wall of a vacuum chamber 26. The vacuum chamber 26 is in fluid flow communication with an engine vacuum source by means of a fluid conduit 27. The diaphragm 21 is biased to a closed position by springs 28 mounted between the diaphragm 21 and the opposite wall 30 of the vacuum chamber. Thus, it can be seen that an increase in engine vacuum causes the diaphragm 21 to move against the bias of the springs for opening the inlet port 23.

The valve stem of the valve closure member passes through a bushing 32, a shield 31 (to protect the bushing from deposits), and a diaphragm 21. In order to prevent deformation of the diaphragm 21, a spring support plate 33 and a valve stem support plate 34 are placed on either side of the diaphragm 21, the support plate 34 resting on a shoulder 35 in the valve stem 25. The assembly of the support plates and diaphragm are locked to the valve stem. The springs may be relatively low stress, type 302 stainless steel or 17-7 PH stainless steel, which do not have characteristic inversions when higher temperatures are experienced. The valve stem has a staked joint at the pintle on one end 46, the diaphragm head at the other 47. These joints must be capable of withstanding 200 pound linear pull loads and vibrations, as noted previously, without failure.

The diaphragm 21 is made from silicone rubber effective to withstand the high temperatures to be experienced. Materials of the assembly are tested by cycling the diaphragm one million times at full stroke and at 500° F. without failure or significant increase in the system leakage rate.

Figure 3:
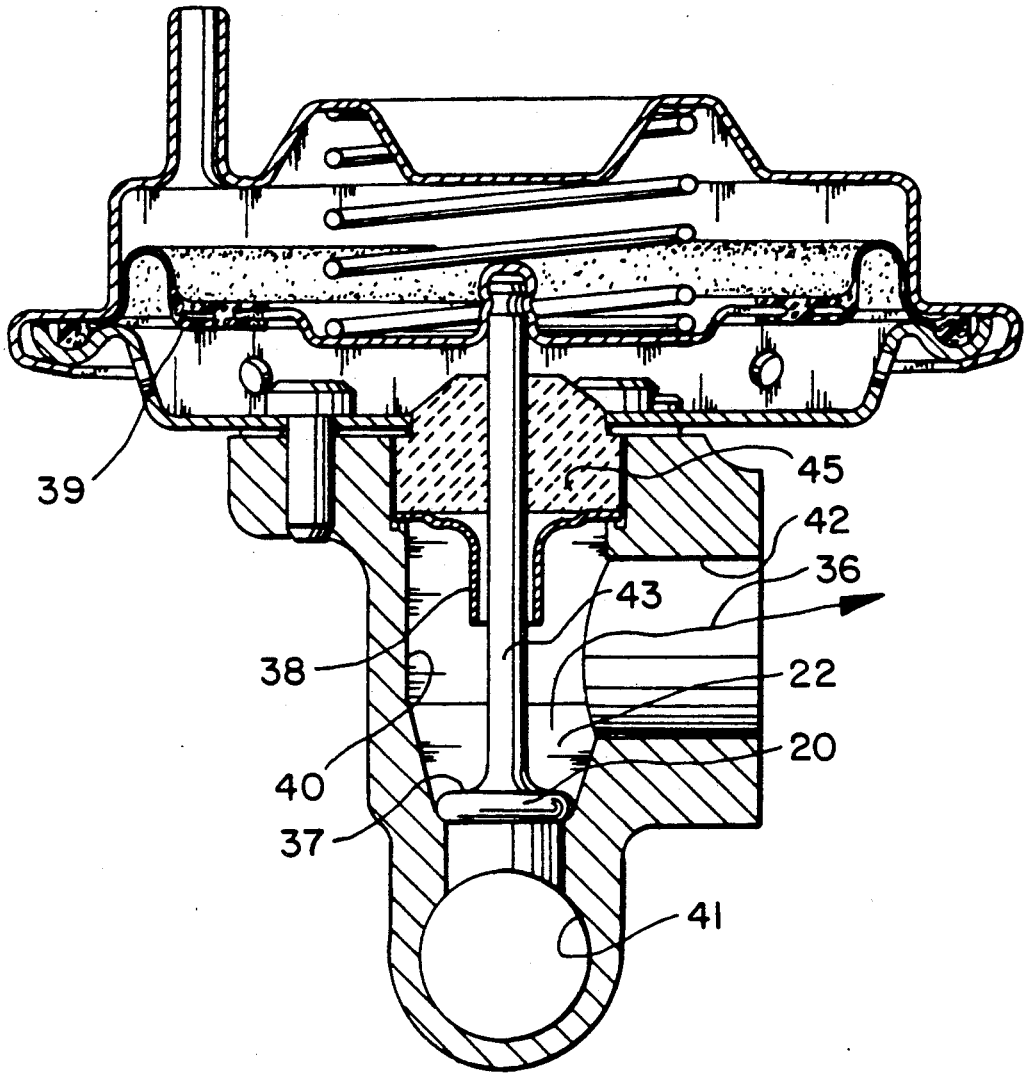
FIG. 3 is another type of EGR valve construction embodying the principles of this invention.

The valve assembly may have different bushing alternative constructions, such as bushing 45, shown in FIG. 3. Varying degrees of guidance required for different valve sealing mechanisms demand different configurations. Larger bushings provide a better pilot for the valve, thus better sealing. The cast iron body has a chamber 40 with an inlet 41 controlled by a valve pintle 37 allowing flow 36 to exit from outlet 42. The valve stem 43 is moved by diaphragm 39 and is protected by shield 38.

Bushing and Stem Interface

The construction of this invention uses an interface between the stem bushing and the stem itself that consists of a select ceramic for the bushing and a select physically impregnated ingredient in a high temperature resistant steel of the stem.

The ceramic for the bushing must exhibit high wear resistance, high corrosion resistance, and high dimensional stability at temperatures in excess of 800° F. and is compatible in sliding contact engagement with the ingredient impregnated in the stem of this invention. Ceramics meeting this criteria for purposes of this invention can be selected from a group consisting of silicon nitride formed either by reaction bonding, hot pressing, or as a sintered blend of silicon nitride or silicon carbide; silicon carbide formed by hot pressing which is siliconized or includes 10-20% graphite; alumina; and a metal matrix ceramic having either a metal matrix with ceramic impregnation or a ceramic matrix with metal impregnation. Siliconizing silicon carbide may be obtained by converting a carbon preform into silicon carbide by capillary action of liquid silicon resulting in varying degrees of residual silicon in the silicon carbide body. Techniques for forming such ceramics into bulk shapes is known.

The impregnation ingredient for the high temperature steel of the valve stem must (i) have high hardness at ambient or room temperatures greater than 60 $R_c$, and (ii) be effective in forming a lubricating oxidized passivation layer at temperatures in excess of 600° C. Ingredients which meet these requirements and are compatible in sliding contact engagement with ceramic at high temperatures, include electroless nickel, electrolytic chromium, and nitrides applied either by ion implantation or by chemical nitridation. Techniques for impregnating these ingredients are known.

Figure 4:
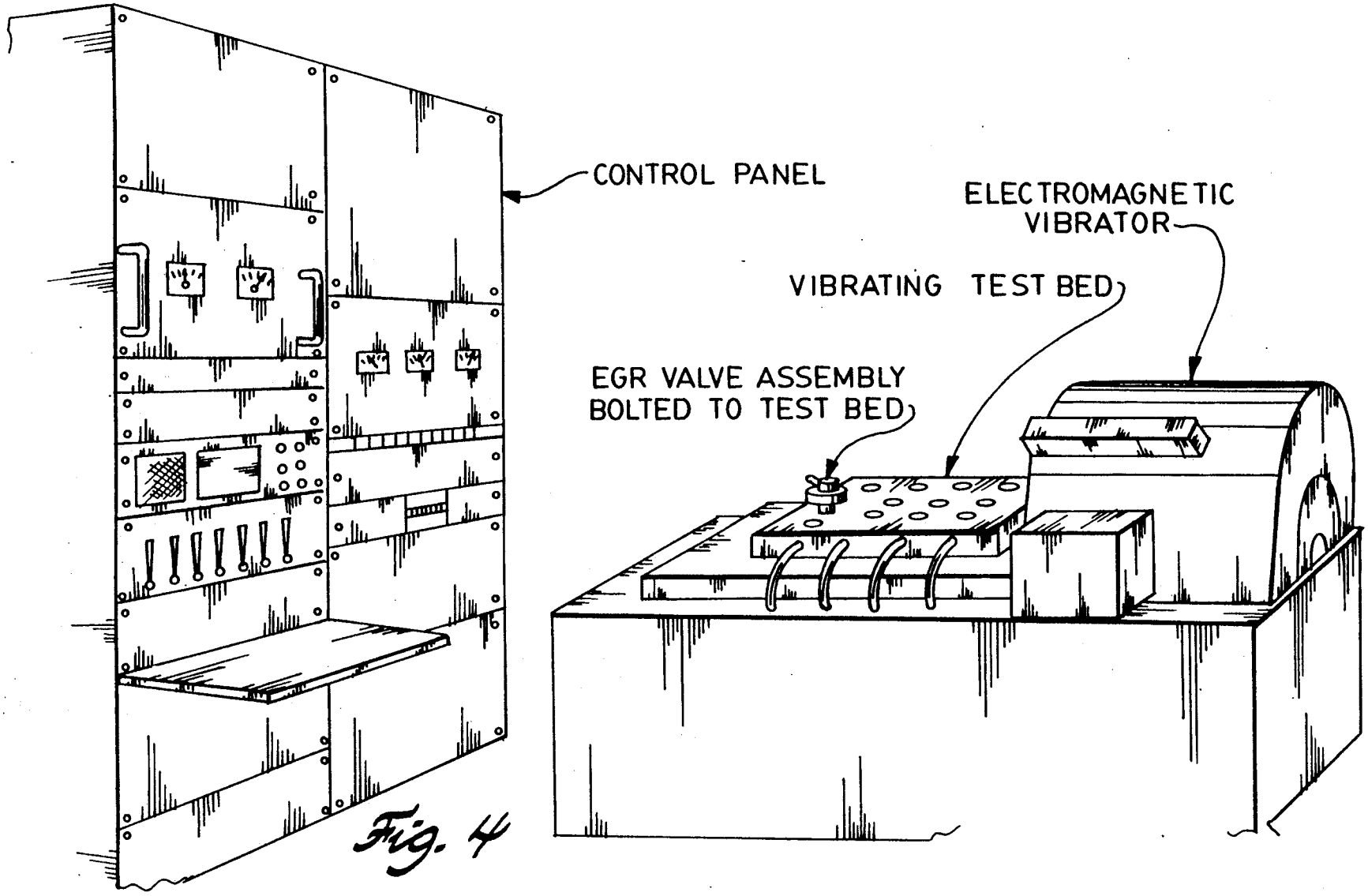
FIG. 4 is a sketch of a vibratory and cold cycling test rig used to evaluate the present invention.

What was not known is the unique low cost wear and high temperature resistant interface that results. A series of samples was prepared to illustrate the benefits of this invention, particularly when compared with the materials of the prior art. As shown in Table 1, specific identification of the bushing material, stem, core material, and stem impregnation material appears in column 1 for each sample. These samples were all subjected to a series of three tests: the first included a rotary wear test at room temperature; the second a sliding wear test at high temperatures; and a third consisting of a vibration of the interface structure in the valve assembly according to a predetermined strategy and cold cycling of such interface also according to a predetermined strategy. Leakage was measured before and after each of these tests. The vibration aspect consisted of vibrating the EGR valve assembly 50 hours each in two axes at vibration frequencies and acceleration levels specified in Table 2; the cold cycling consisted of cycling at a rate between room temperature and −20° F. at a vacuum level specified in Table 3. The vibration and cold cycling may be carried out by an apparatus as shown in FIG. 4.

The rotary wear test was carried out by revolving a metallic wheel against a cylinder of bushing material with a predetermined force and noting the presence of any wear groove with time.

Figure 5:
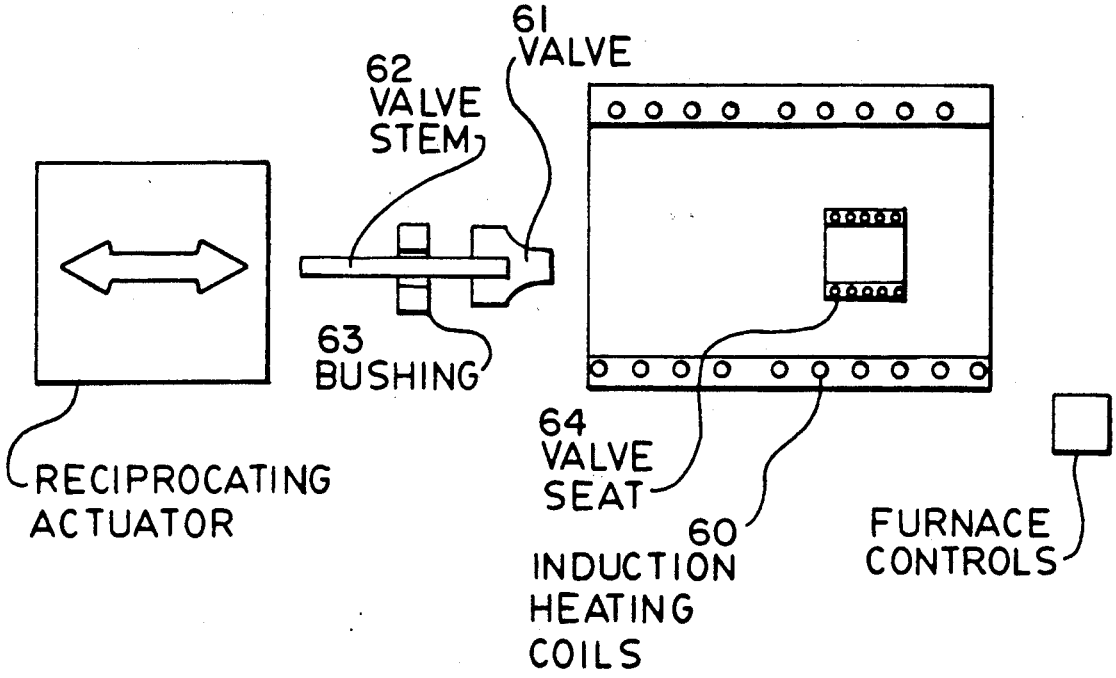
FIG. 5 is a sketch of a sliding wear test rig for high temperature testing utilized in achieving the test results of this invention.

The hot sliding wear test was carried out by a system as shown in FIG. 5. It consisted of an induction heating furnace 60 into which the valve 61, stem 62, and bushing 63 are shifted to repeatedly and reciprocately engage the valve seat 64 at high temperatures.

Note from the test results presented in Table 1 that only the combinations of ceramic materials within the scope of this invention and the ingredients impregnating the stem performed to the criteria of this invention of having leakage less than 0.60 scfm and a projected hardness at room temperature of at least 60 $R_c$.

While particular embodiments of the invention have been illustrated and described, it will be obvious to those skilled in the art that various changes and modifications may be made without departing from the invention, and it is intended to cover in the appended claims all such modifications and equivalents as fall within the true spirit and scope of this invention.

TABLE 1

| All Parts Subjected to 1300° F. Prior to Testing Except * | | | Product Validation Test Room Temperature Cycling Leakage Before / After (scfm) | |
|---|---|---|---|---|
| Bushing Material | Stem Core Material | Stem Surface Treatment | | |
| $Si_3N_4$ | 303 stainless steel | nitrided | .13 | .26 |
| SiC | 303 stainless steel | " | .17 | .18 |
| *SiC | 303 stainless steel | electroless Ni | .07 | .07 |
| $Al_2O_3$ | 303 stainless steel | nitrided | .17 | .25 |
| Bronze/ Graphite | 303 stainless steel | none | .14 | 1.10 |
| | (.60 scfm maximum allowable leakage) | | | |

*This sample was heated to between 900–1000° F.

TABLE 2

| Production Validation Vibration Schedule | | | | | | | |
|---|---|---|---|---|---|---|---|
| Frequency (Hz) | 50–125 | 125–220 | 220–310 | 310–450 | 450–650 | 650–850 | 850–1050 |
| Accel. G's (peak) | 5.7 | 25.5 | 3.1 | 3.7 | 10.9 | 3.0 | 15.3 |

TABLE 3

| Production Validation Cycle Life Test Schedule | | | | |
|---|---|---|---|---|
| Time (hrs) | 0–18 | 18–20 | 20–22 | 22–24 |
| Temperature (°F.) | "X" | "X" to −20 | −20 | −20 to "X" |
| Vac. Level (in. Hg.) | 3 (see note) | 4 | 4 | 4 |
| Vacuum (cycles/min) | 30 | 6 | 6 | 6 |

I claim:

1. An EGR valve assembly for use in an EGR valve body having walls defining a chamber with an inlet and outlet, comprising:

(a) a stemmed reciprocable valve controlling flow into said chamber, the stem of said valve being constituted of an iron-based core impregnated at its outer surface with an ingredient compatible in sliding contact with ceramic and provides said stem with a surface hardness at room temperature of at least 60 $R_c$ and a lubricating oxidized passivation layer at temperatures in excess of 600° C.; and (b) a ceramic-based bushing for sealingly guiding the reciprocal movement of said stem.

2. The EGR valve assembly as in claim 1, in which said iron-based stem core is comprised of Series 300 and 400 stainless steel.

3. The EGR valve assembly as in claim 1, in which said impregnated ingredient is selected from the group consisting of electroless nickel, electrolytic chromium, and nitrides impregnated by ion implantation or by bath nitriding.

4. The EGR valve assembly as in claim 1, in which said valve assembly is effective to operate at temperatures in excess of 900° C. and in which said ingredient is restricted to nitrides impregnated by ion implantation or bath nitriding.

5. The EGR valve assembly as in claim 1, in which said ceramic-based bushing is selected from the group consisting of silicon nitride, silicon carbide, alumina, or mixtures thereof, and a ceramic/metal matrix with the matrix either being ceramic or metal.

6. The EGR valve assembly as in claim 5, in which said bushing is silicon carbide and is siliconized or contains 5–15% graphite.

7. The EGR valve assembly as in claim 5, in which said bushing is silicon nitride which is reaction bonded, hot pressed, or sintered.

8. An EGR valve assembly for use in an EGR valve body having walls defining a chamber with an inlet and outlet, comprising:

(a) a stemmed reciprocable valve controlling flow into said chamber, the stem of said valve being constituted of an iron-based core impregnated at its outer surface with an ingredient compatible in sliding contact with ceramic and provides said stem with a surface hardness at room temperature of at least 90 $R_c$ and a lubricating oxidized passivation layer at temperatures in excess of 600° C.; and (b) a ceramic-based bushing for sealingly guiding the reciprocal movement of said stem.

9. An EGR control valve comprising:

a valve body having a chamber with an inlet and outlet and defining a valve seat;

a valve closure member having a stem and a head on said stem for mating with said seat to close said inlet against flow;

a ceramic-based bushing supported by said body for sealingly guiding reciprocable movement of said stem;

diaphragm actuating means operatively connected to said stem and being responsive substantially to engine valve with respect to said valve seat said stem being constituted of an iron-based core material impregnated at its outer surface with an ingredient that is compatible in sliding contact with said bushing and provides (i) a hardness for said stem at room temperature of at least 60 $R_c$, and (ii) a lubricating oxidized passivation layer at temperatures in excess of 600° C.

* * * * *